US009088096B2

(12) United States Patent
Toratani et al.

(10) Patent No.: US 9,088,096 B2
(45) Date of Patent: Jul. 21, 2015

(54) POWER FEED CONNECTOR

(71) Applicant: FURUKAWA ELECTRIC CO., LTD., Tokyo (JP)

(72) Inventors: Tomoaki Toratani, Tokyo (JP); Naomi Takahashi, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/059,884

(22) Filed: Oct. 22, 2013

(65) Prior Publication Data

US 2014/0045360 A1 Feb. 13, 2014

Related U.S. Application Data

(63) Continuation of application No. PCT/JP2012/076404, filed on Oct. 12, 2012.

(30) Foreign Application Priority Data

Oct. 25, 2011 (JP) ..... 2011-233563

(51) Int. Cl.
*H01R 13/62* (2006.01)
*H01R 13/639* (2006.01)
(Continued)

(52) U.S. Cl.
CPC ..... *H01R 13/62* (2013.01); *H01R 13/6272* (2013.01); *H01R 13/639* (2013.01); *H01R 13/641* (2013.01)

(58) Field of Classification Search
CPC .. H01R 13/639; H01R 13/6272; H01R 13/62; H01R 13/641
USPC ..... 439/345, 350–352, 157, 310–311, 372
See application file for complete search history.

(56) References Cited

U.S. PATENT DOCUMENTS 5,545,049 A 8/1996 Hasegawa et al.
5,575,675 A 11/1996 Endo et al.
(Continued)

FOREIGN PATENT DOCUMENTS

EP 0635908 A2 1/1995
EP 0646995 A2 4/1995
(Continued)

OTHER PUBLICATIONS

International Search Report corresponding to PCT/JP2012/076404, dated Jan. 15, 2013. Extended European Search Report issued May 20, 2015, corresponding to European patent application No. 12843832.2.
(Continued)

*Primary Examiner* — Edwin A. Leon
(74) *Attorney, Agent, or Firm* — Lowe Hauptman & Ham, LLP

(57) ABSTRACT

A case is a cylinder-shaped member and accommodates a connector body in a front end portion thereof. The connector body can slide back and forth with respect to the case. The case is provided with a slider in the inside thereof. One of the end portions of the slider projects forward from the case. The slider can slide in an axial direction. A stopper member is provided near a front end of a connector bar, at the back of the slider. The stopper member touches the slider and can move in response to movement of the slider. The stopper member locks the case and the holding member. That is, the stopper member functions as a case-locking mechanism for preventing the case from moving with respect to a holding member.

7 Claims, 10 Drawing Sheets

(51) Int. Cl.
*H01R 13/641* (2006.01)
*H01R 13/627* (2006.01)

(56) References Cited

U.S. PATENT DOCUMENTS

| | | | | |
|---|---|---|---|---|
| 5,664,960 | A | 9/1997 | Fukushima | |
| 5,873,737 | A | 2/1999 | Hashizawa et al. | |
| 6,123,569 | A * | 9/2000 | Fukushima et al. | 439/456 |
| 6,283,781 | B1 | 9/2001 | Mori | |
| 8,206,171 | B2 * | 6/2012 | Osawa et al. | 439/352 |
| 8,500,476 | B2 * | 8/2013 | Hori et al. | 439/310 |
| 2002/0177348 | A1 | 11/2002 | Karamatsu et al. | |

FOREIGN PATENT DOCUMENTS

| | | | |
|---|---|---|---|
| JP | 6-188044 | A | 7/1994 |
| JP | 7-282902 | A | 10/1995 |
| JP | 9-223534 | A | 8/1997 |
| JP | 2001-135414 | A | 5/2001 |
| JP | 2002-352909 | A | 12/2002 |
| JP | 2011-138644 | A | 7/2011 |
| JP | 2012-174643 | A | 9/2012 |
| WO | 2011/081124 | A1 | 7/2011 |

* cited by examiner (a)

(b)

(a)

(b)

(a)

(b)

(a)

(b)

(a)

(b)

(a)

(b)

-Prior Art-

POWER FEED CONNECTOR

RELATED APPLICATIONS

The present application is a continuation of International Application Number PCT/JP2012/076404, filed Oct. 12, 2012, and claims priority from, Japanese Application Number 2011-233563, filed Oct. 25, 2011. The above listed applications are hereby incorporated by reference in their entirety.

TECHNICAL FIELD

The present invention relates to a power feed connector (power-feeding connector) for boost-charging, which is used for electric vehicles, etc.

BACKGROUND ART

Recently, electric vehicles that do not make use of fossil fuel have been attracting attention in terms of global environmental issues. An electric vehicle is equipped with a battery for driving and can travel by electricity charged in the battery.

As means for charging a battery of an electric vehicle, there are two methods, that is, a method for charging from a normal household power source and a method for boost-charging with a special charging device. In the method for charging from a household power source, a special connector is not required but a battery tends to be charged during the time while the vehicle is not used such as during nighttime because it takes a long time to charge a battery. On the other hand, in order to continuously drive an electric vehicle for a long distance, it is necessary to perform boost-charging of a battery at charging facilities that are provided in various places in the same manner as conventional charging at gas stations.

As such a power-feeding connector used for electric vehicles, for example, a power-feeding connector comprising a case, a connector body that is slidably attached to the case and accommodates a plurality of terminals therein, a handle that is formed in the shape of a pipe and is slidably attached in the same axial direction as that of the connector body, and a lever, wherein the handle moves forward by rotation of the lever, and thereby the connector body is engaged with a connector body of a power-receiving connector has been known (Patent document 1).

RELATED ART

Patent Document

Patent document 1: Japanese Patent Application Laid-Open No. H06-188044

SUMMARY

When connecting a connector for boost-charging, a relatively large-sized terminal is required to be inserted, and accordingly insertion resistance of the connector becomes large. Regarding this point, the connector provided in Patent Document 1 supports junction between the power-feeding connector and the power-receiving connector by use of the lever. However, there are problems in the technique provided in Patent Document 1 such that it is difficult for a user to recognize when to operate the lever. Furthermore, it is not necessarily easy for a user to connect them because, when a user operates the lever in a state where a space between the each connector and orientations thereof are not in a predetermined state, the connectors fail to be successfully connected with each other. In addition, there is a problem that it is difficult for a user to intuitively know how the connector moves and how the lever is operated.

FIG. 10 is a schematic view of a conventional power-feeding connector 100. The power-feeding connector 100 is provided with a connector body 101 at an end portion thereof and is connected to a power-receiving connector (not shown). An operator connects them with a handle 103 in the hand. In this process, the operator receives connection resistance F1 (such as insertion friction of a plurality of terminals) occurred between the power-receiving connector and the power-feeding connector, and accordingly the operator needs to push the power-feeding connector with a force F2 that is comparable to the F1.

Furthermore, in the power-feeding connector 100, the handle 103 is not formed on an extended line of a central axis of the connector body, and accordingly the force F1 causes a moment M1 at the handle 103 and an operator needs to cause a moment M2 of the force against the moment M1. In this way, it is difficult for an operator to know how to keep balance of the force that is required for connecting the connectors, and consequently it becomes difficult to connect them in a sensual way.

The present invention was made in view of such problems, and an object of the present invention is to provide a power-feeding connector used for electric vehicles, which does not require a great force but is easily operated at the time of connection.

In order to achieve the object described above, a first aspect of the present invention provides a power-feeding connector used for an automobile, comprising a connector body, a case that accommodates the connector body therein, a holding member that is attached to the case, and a case-locking mechanism that restricts a movement of the case with respect to the holding member, wherein the connector body and the holding member are slidable in a substantially same axial direction with respect to the case when the case-locking mechanism is unlocked, and the connector body is movable forward with respect to the case with a movement of the holding member when the holding member moves forward with respect to the case in a state where the case-locking mechanism is unlocked.

It is desirable that insertion detecting means of the power-feeding connector include a pin that is formed slidably in an inserting and removing direction of the case, on a portion of the case which inserts into the power-receiving connector, an elastic member that urges the pin in an inserting direction of the case, and a switch that detects the pin resists the elastic member and is pushed, and the case-locking mechanism is a stopper member that locks the case and the holding member and is actuated by electromagnetic solenoid, and when detecting that the pin touches the power-receiving connector and is pushed inwardly to the case, the switch actuates the electromagnetic solenoid to move the stopper member so that the case-locking mechanism is unlocked.

It is desirable the insertion detecting means that detect the case is inserted into a power-receiving connector is included in the power-feeding connector, and the insertion detecting means are configured to unlock the case-locking mechanism when detecting that the case is inserted into the power-receiving connector.

The insertion detecting means may include a slider that is formed slidably in an inserting and removing direction of the case, on a portion of the case which inserts into the power-receiving connector, and an elastic member that urges the slider in an inserting direction of the case, and the case-locking mechanism is a stopper member that locks the case and the holding member, and when the slider touches the power-receiving connector and is pushed inwardly to the case, the stopper member moves so that the case-locking mechanism is unlocked. In this case, a plurality of sliders may be arranged symmetrically with each other against a central axis of the connector body.

It is desirable that a speed reduction mechanism is provided in the holding member and the holding member and the connector body move with respect to the case via the speed reduction mechanism, and when the holding member moves with respect to the case, a movement distance of the connector body with respect to the case becomes smaller than a movement distance of the holding member with respect to the case.

That the case may be provided with a hole, and a position of the slider in an inside of the case is viewed through the hole.

According to the present invention, when a holding member is pushed with respect to a case, a connector body moves in the same direction that of the holding member. With this configuration, it is possible for an operator to recognize movement of the connector body and understand connecting operations sensually, and thereby the procedures for connecting a power-feeding connector to a power-receiving connector can be performed easier.

Furthermore, because a speed reduction mechanism is provided in the inside of the power-feeding connector so that a movement distance of the connector body is set to be smaller than a movement distance of the holding member, the holding member can be moved with a force smaller than a resistance force that is applied on the connector body at the time of connecting the power-feeding connector and the power-receiving connector. Therefore, the procedures for connecting the connectors can be performed with a smaller force.

Furthermore, insertion detecting means that detect the case is inserted into the power-receiving connector is provided therein. When the insertion detecting means detect that the case is inserted into the power-receiving connector, a case-locking mechanism is unlocked. Accordingly, even if the case is not completely inserted into the power-receiving connector, movement of the connector can be prevented. For example, when a part of the case contacts a periphery of the power-receiving connector, the connector body would not be moved.

Therefore, even when the insertion detecting means are combined with the speed reduction mechanism, the effect above can also be obtained because the speed reduction mechanism does not work before the case is not inserted completely into the power-receiving connector.

The insertion detecting means are configured such that, when a slider that can slide in an inserting and removing direction of the case is urged by an elastic member and the slider touches the power-receiving connector and is pushed inwardly to the case, a stopper member that locks the case and the holding member moves and then the case-locking mechanism is unlocked. With this simple configuration, it is possible to successfully detect that the case is inserted into a charging connector.

In this case, when a plurality of sliders is arranged symmetrically against a central axis of the connector body, a reaction force is equally applied on a central axis of the case because the sliders are pushed backwardly at positions symmetrical against an inserting axis. Therefore, it is possible to insert the case into the power-receiving connector more accurately.

Furthermore, when the connector is configured with a hole provided in the case so that the slider in the inside of the case can be viewed, it is possible to recognize whether the slider is successfully pushed. Therefore, it is possible to successfully determine whether the case is inserted into the power-receiving connector accurately.

Furthermore, a switch and electromagnetic solenoid can be used for the insertion detecting means. With this configuration, it is possible to detect insertion and unlock the case with a smaller force without a mechanism that moves a stopper member by pressing the slider thereon.

Effect of the Invention

According to the present invention, it is possible to provide a power-feeding connector used for electric vehicles, which does not require a great force but is easily operated at the time of connection.

DESCRIPTION OF SOME EMBODIMENTS

Figure 1:
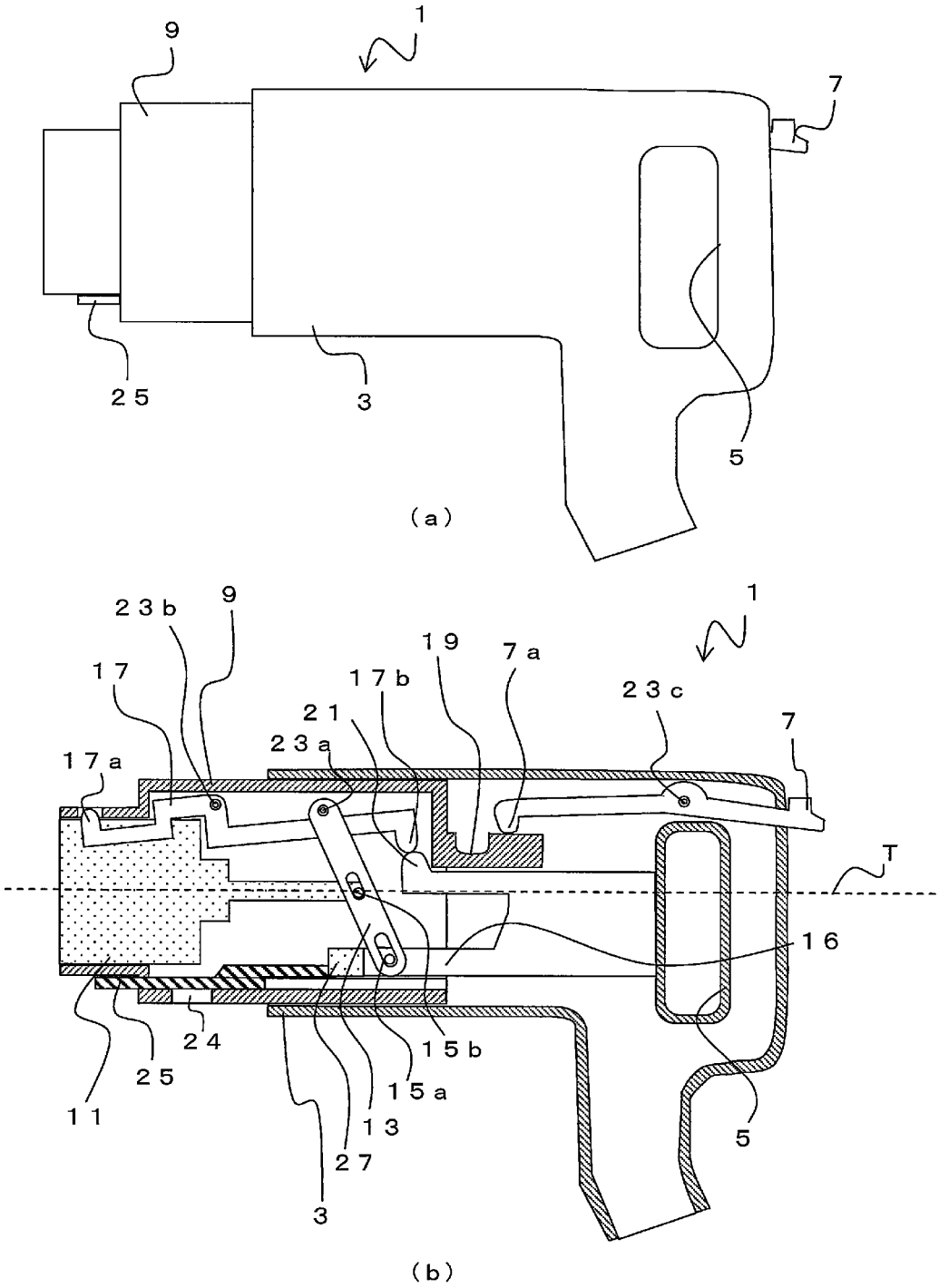
FIG. 1 illustrates a power-feeding connector 1, and particularly FIG. 1 (*a*) is a side view and FIG. 1 (*b*) is a cross-sectional side view.

Hereinafter, an embodiment according to the present invention will be described with reference to the drawings. FIG. 1 is a schematic view of a power-feeding connector 1, and particularly FIG. 1 (*a*) is a side view and FIG. 1 (*b*) is a cross-sectional side view. In the present invention, a state illustrated in FIG. 1 is called a normal state. Also, a cable, etc.

is not illustrated in the following drawings. The power-feeding connector 1 mainly includes a holding member 3, a case 9, and a connector body 11.

As illustrated in FIG. 1 (*a*) and FIG. 1 (*b*), the holding member 3 is provided with a handle 5 at one of the end portions (backward) thereof. The handle 5 is a portion to be held in the hand when an operator operates the power-feeding connector 1. The handle 5 is formed such that at least a part of the handle 5 is set on an extended line of a central axis of the connector body (illustrated as the line T in FIG. 1 (*b*), a central axis in a movement direction of the connector body 11, which is described below). With this configuration, when pushing the holding member 3, it is possible to prevent a moment from being generated with a reaction force of interconnection resistance between the connectors, and thereby it becomes easy to operate the power-feeding connector.

The holding member 3 can accommodates various constituent elements in the inside thereof. A case 9 is provided at the other end portion (forward) of the holding member 3. A portion near a front end portion of the holding member 3 is formed in the shape of a cylinder, and a part of the case 9 (a back portion) is accommodated in the inside of the holding member 3. The holding member 3 can slide back and forth with respect to the case 9.

The case 9 is a cylinder-shaped member and accommodates the connector body 11 in a front end portion thereof. The connector body 11 can slide back and forth with respect to the case 9. On respective portions on which the holding member 3 and the connector body 11 slide with respect to the case 9, a guiding mechanism (not shown) and a stopper for restricting the sliding range may be arranged.

The case 9 is provided with an arm 13 in the inside thereof. A portion near one of the end portions of the arm 13 is rotatably attached to the case 9 by a pin 23*a*. A portion near the other end portion of the arm 13 is coupled, by a connecting part 15*a*, to a connector bar 16 that is joined with the holding member 3. The arm 13 includes a long hole formed therein and the connector bar 16 includes a pin, etc. formed thereon so that the arm 13 and the connector bar 16 are rotatably connected by the connecting part 15*a*.

A substantially central portion (a portion between the pin 23*a* and the connecting part 15*a*) of the arm 13 is connected to the connector body 11 by the connecting part 15*b*. The connecting part 15*b* is configured in the same manner as the connecting part 15*a*. Therefore, when the arm 13 rotates, the connector body 11 and the holding member 3 can move in the straight line with respect to the case 9 in connection with rotary of the arm 13.

The case 9 is provided with a locking member 17 formed in the inside thereof. The locking member 17 is rotatably attached to the case 9 by a pin 23*b*. A locking pin 17*a* is formed on an end portion at a front side of the locking member 17 so as to be faced upwardly. The locking pin 17*a* is placed on a position of a hole that is formed in the case 9.

An engaging part 17*b* is formed on an end portion at a back side of the locking member 17 so as to be faced downwardly. The engaging part 17*b* is formed convexly so that the engaging part 17*b* and an engaging part 21 can be engaged with each other. The engaging part 21 is fixed on the part of holding member 3. In the normal state, the engaging parts 17*b* and 21 are not engaged with each other but a projection of the engaging part 17*b* is set on a projection of the engaging part 21. Furthermore, in the normal state, the engaging part 17*b* is pushed upwardly by the engaging part 21, and accordingly the locking pin 17*a* does not project from the case 9 (the hole formed in the case 9) and remains within the case 9 via the pin 23*b*.

The holding member 3 is provided with an operating part 7 in the inside thereof. The operating part 7 is rotatably attached to the holding member 3 by a pin 23*c*. An end portion at a back side of the operating part 7 projects from the holding member 3 toward an outside so that an operator can operate the operating part 7 from the outside. A locking pin 7*a* is formed at a front side of the operating part 7 so as to be faced downwardly. The locking pin 7*a* touches a part of the case 9, and thus the locking pin 7*a* is pushed upwardly by the part of the case 9 in the normal state. A concave part 19 that enables the locking pin 7*a* to be engaged therewith is provided at a front side of a portion, which touches the locking pin 7*a* in the normal state, of the case 9.

The case 9 is provided with a slider 25 in the inside thereof. One of the end portions of the slider 25 projects forward from the case 9. That is, a step is formed in front of the case 9 and the slider 25 is exposed on the step. The slider 25 can slide in an axial direction (in a movement direction of the case 9 as well as an inserting and removing direction of the connector).

A hole 24 is formed at a part of the case 9. A position of the slider 25 in the inside of the case 9 can be viewed through the hole 24. The arrangement of the slider 25 and the hole 24 is not limited to the example illustrated in the drawings, however, they can be suitably arranged. For example, the hole 24 may be arranged on a top surface or a side surface of the case 9 and the slider 25 may be arranged on a top portion or a side surface of the power-feeding connector in order to make them easier to be visually recognized.

A stopper member 27 is provided near a front end portion of the connector bar 16, at the back of the slider 25. The stopper member 27 touches the slider 25 and is configured to be movable in response to movement of the slider 25. The stopper member 27 locks the case 9 and the holding member 3. That is, the stopper member 27 functions as a case-locking mechanism to prevent the case 9 from moving with respect to the holding member 3. The details of mechanisms and operations of the slider 25 that serves as insertion detecting means and the stopper member 27 that serves as the case-locking mechanism will be described later.

Figure 2:
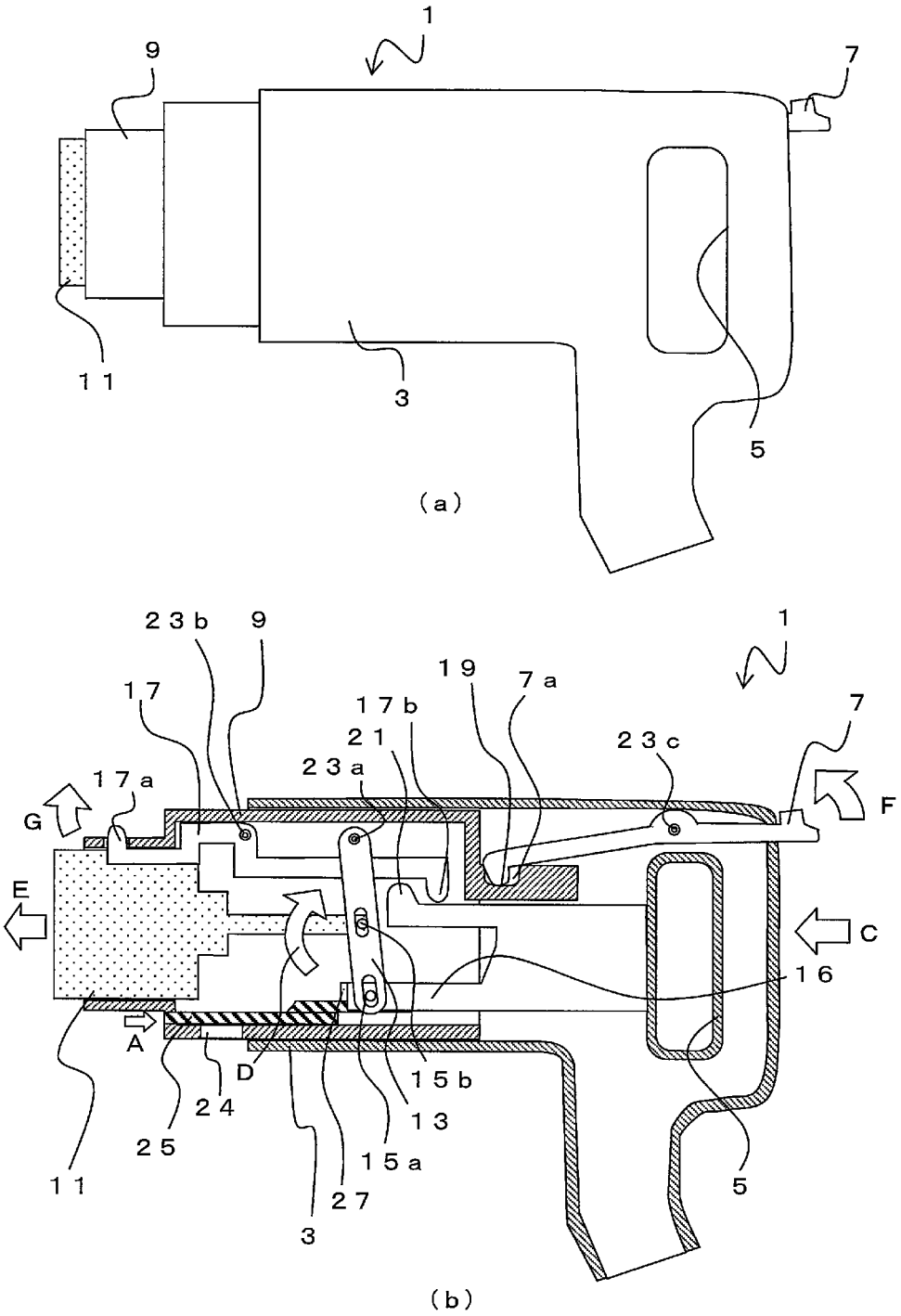
FIG. 2 illustrates a state where a power-feeding connector 1 is operated, and particularly FIG. 2 (*a*) is a side view and FIG. 2 (*b*) is a cross-sectional side view.

Next, a state where the power-feeding connector 1 is operated is described hereinafter. FIG. 2 illustrates the power-feeding connector 1 in which the holding member is moved, and particularly FIG. 2 (*a*) is a side view and FIG. 2 (*b*) is a cross-sectional side view.

As described above, in the normal state, the holding member 3 is locked by the case 9 and the stopper member 27. When the slider 25 is pushed inwardly (in a direction of the arrow A in FIG. 2 (*b*)) from the normal state, the stopper member 27 is pushed and moved by the slider 25. In this process, the holding member 3 and the case 9 are unlocked by the movement of the stopper member 27.

In a state where the holding member 3 and the case 9 are unlocked, when the holding member 3 is moved forward with respect to the case 9 (in a direction of the arrow C in FIG. 2 (*b*)), the connecting part 15*a* that is coupled with the holding member 3 (the connector bar 16) is pushed forward. The connecting part 15*a* moves forward, and accordingly the arm 13 rotates on the pin 23*a* that serves as a rotation axis (in a direction of the arrow D in FIG. 2 (*b*)). When the arm 13 rotates, the connector body 11 that is coupled with the arm 13 by the connecting part 15*b* moves in the same direction as that of the holding member 3 (in a direction of the arrow E in FIG. 2 (*b*)).

Because the position where the holding member 3 couples with the arm 13 is different from the position where the connector body 11 couples with the arm 13, a movement distance of the holding member 3 with respect to the case 9 and that of the connector body 11 with respect to the case 9 differ with each other. Specifically, in the case where the ratio of distances from the pin 23*a* to the connecting part 15*a* and to the connecting part 15*b* is 2:1, if the movement distance of the holding member 3 with respect to the case 9 is set to be 2, the connector body 11 moves a distance of 1. That is, the mechanism such as the arm 13 functions as a speed reduction mechanism.

Furthermore, when the holding member 3 moves forward with respect to the case 9, the engaging part 17*b* and the engaging part 21 are engaged with each other. Consequently, the locking member 17 rotates on the pin 23*b* that serves as a rotation axis. In other words, when the engaging part 17*b* that is one of the sides of the locking member 17 is pushed downwardly, the locking member 17 rotates and then the locking pin 17*a* that is the other side of the locking member 17 is pushed upwardly. Thereby, the locking pin 17*a* projects through the hole toward the outside of the case 9 (in a direction of the arrow G in FIG. 2 (*b*)). The locking member 17 may be configured with a spring, etc. so as to always resume the state illustrated in FIG. 2 (the state where the engaging part 17*b* is pushed downwardly).

Furthermore, when the holding member 3 moves forward with respect to the case 9, the locking pin 7*a* of the operating part 7 moves toward a direction of the concave part 19 and then the locking pin 7*a* is engaged with the concave part 19. Consequently, the operating part 7 rotates on the pin 23*c* that serves as a rotation axis. In other words, when the locking pin 7*a* is pushed downwardly, the operating part 7 rotates and then the other end portion of the operating part 7 is pushed upwardly (in a direction of the arrow F in FIG. 2 (*b*)). The operating part 7 may be configured with a spring, etc. so as to always resume the state illustrated in FIG. 2 (the state where the locking pin 7*a* is pushed downwardly).

When the locking pin 7*a* engages with the concave part 19, movement of the holding member 3 with respect to the case 9 is locked. That is, the operating part 7 functions as locking means to prevent the holding member 3 (and the connector body 11) from moving with respect to the case 9. Furthermore, the operating part 7 functions as an unlocking mechanism to unlock the locked state by being operated (the outer end portion of the operating part 7 is pushed downwardly). With the configuration above, a connection state of the connector can be successfully maintained as well as it can be easily unlocked.

A display part that displays a position of the operating part 7 may be provided on an upper portion of the handle 5. For example, the operating part 7 is in a state where a side of the locking pin 7*a* thereof is pushed upwardly in the normal state illustrated in FIG. 1. Accordingly, in the state above, the operating part 7 rotates in a right-handed direction of FIG. 1 on the pin 23*c* that serves as an axis. On the other hand, in the state illustrated in FIG. 2, a side of the locking pin 7*a* of the operating part 7 is pushed downwardly. Accordingly, the operating part 7 rotates in a left-handed direction of FIG. 2 on the pin 23*c* that serves as an axis.

Here, a hole is provided as the display part on a part of the holding member 3 so that a state of the operating part 7 can be recognized through the display part. With this configuration, whether the power-feeding connector 1 is in a locked state (the state illustrated in FIG. 2) or in an unlocked state (the normal state) can be easily viewed. Other methods for viewing a state of the operating part 7 and other arrangements of the display part may be applied herein.

Furthermore, a parallel linkage may be used in a portion where the holding member 3 (or the connector body 11) slides on the case 9. By using the parallel linkage, the backlash hardly occurs when the holding member 3 (or the connector body 11) slides on the case 9, and it is possible to restrict a movement range therebetween.

Figure 3:
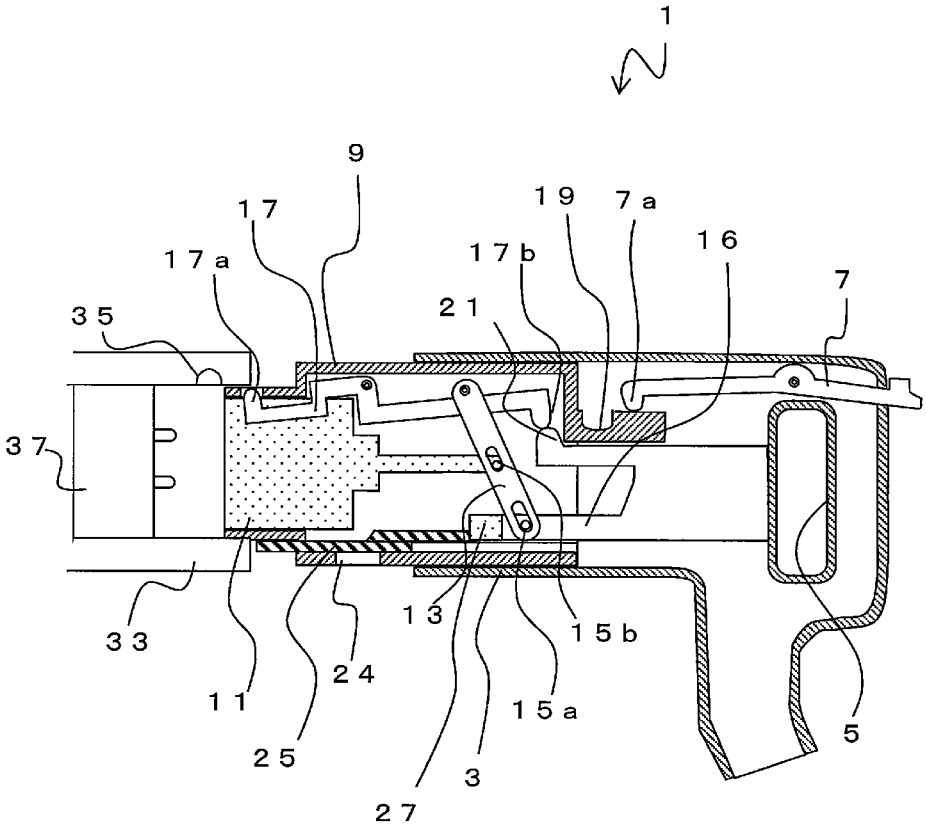
FIG. 3 illustrates a state where a power-feeding connector 1 and a power-receiving connector 33 are connected with each other, and particularly FIG. 3 (*a*) is a cross-sectional side view and FIG. 3 (*b*) is a bottom perspective view illustrating operations of a slider 25, etc.
Figure 3:
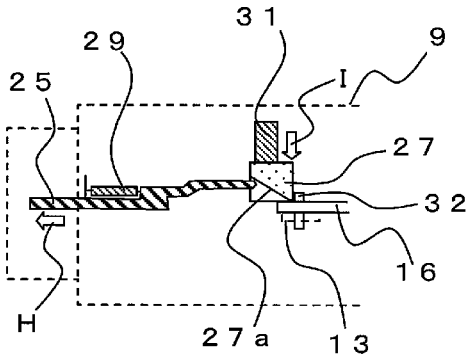
Figure 4:
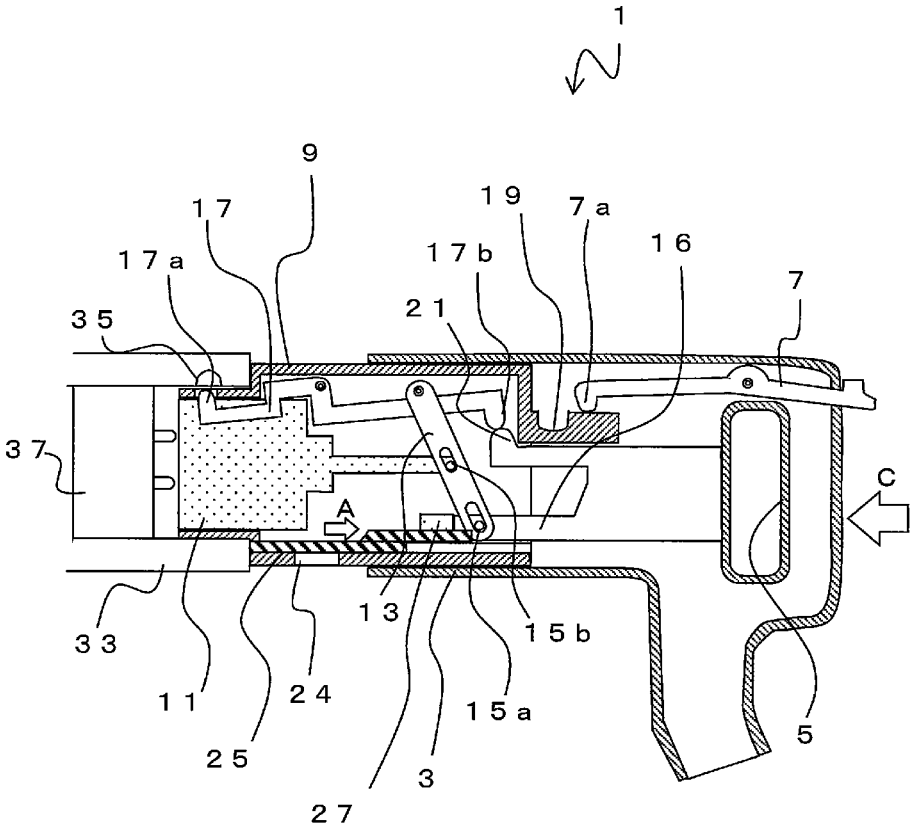
FIG. 4 illustrates a state where a power-feeding connector 1 and a power-receiving connector 33 are connected with each other, and particularly FIG. 4 (*a*) is a cross-sectional side view and FIG. 4 (*b*) is a bottom perspective view illustrating operations of a slider 25, etc.
Figure 4:
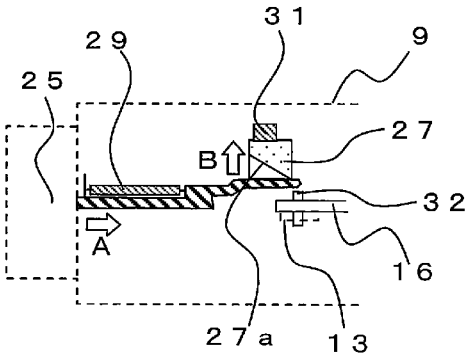
Figure 5:
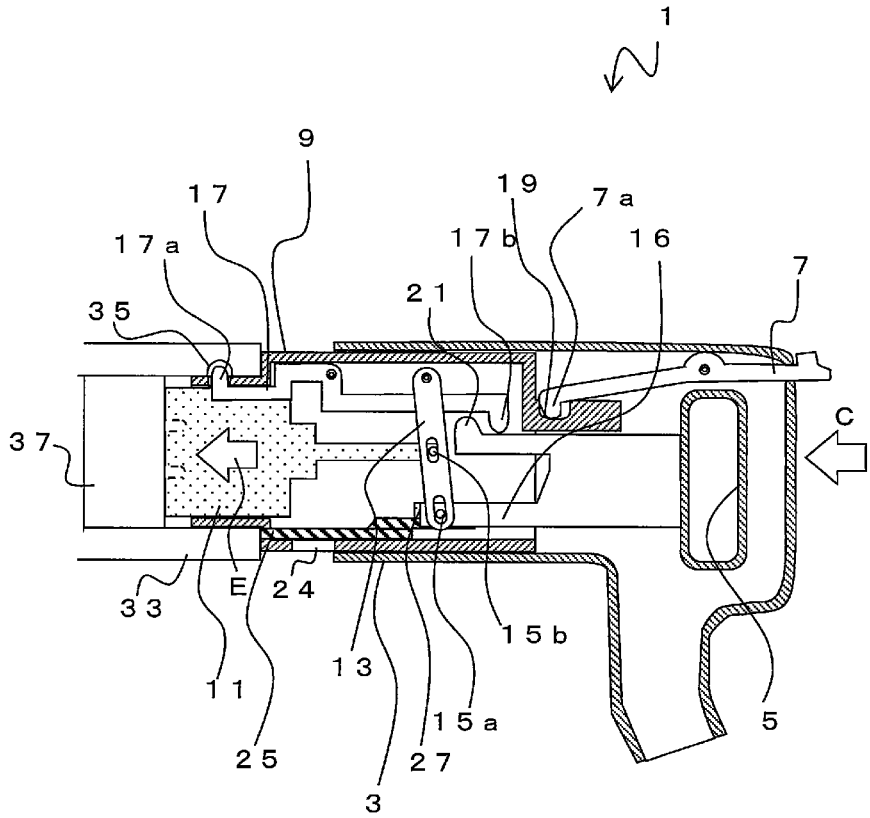
FIG. 5 illustrates a state where a power-feeding connector 1 and a power-receiving connector 33 are connected with each other, and particularly FIG. 5 (*a*) is a cross-sectional side view and FIG. 5 (*b*) is a bottom perspective view illustrating operations of a slider 25, etc.
Figure 5:
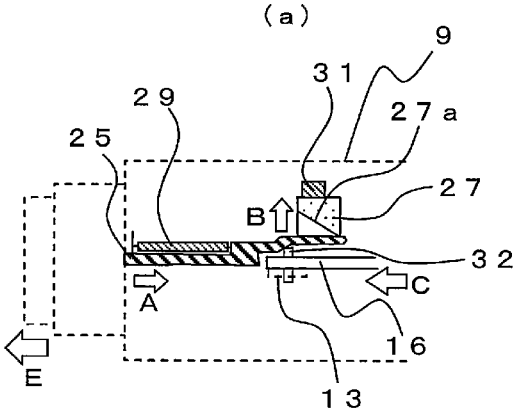

Next, a method for using the power-feeding connector 1 will be described hereinafter. FIG. 3 to FIG. 5 illustrate processes of connecting the power-feeding connector 1 and a power-receiving connector 33, and particularly FIG. 3 (*a*) to FIG. 5 (*a*) are cross-sectional side views and FIG. 3 (*b*) to FIG. 5 (*b*) are bottom perspective views illustrating operations of the slider 25, etc.

First, as illustrated in FIG. 3 (*a*), the power-feeding connector 1 in the normal state is set to face to the power-receiving connector 33 that is to be connected. Specifically, a front end of the case 9 is inserted into a concave part of the power-receiving connector. Here, the power-receiving connector 33 accommodates a connector body 37 in the inside thereof. In the state above, there is a space between the connector bodies 11 and 37 so that a female terminal of the connector body 11 and a male terminal of the connector body 37 are not connected with each other.

Accordingly, as illustrated in FIG. 3 (*b*), a front end of the slider 25 does not touch the power-receiving connector 33 but projects forward from the case 9. The slider 25 is always urged forward (in a direction of the arrow H in FIG. 3 (*b*)) by an elastic member 29 that is provided in the inside of the case 9. That is, the slider 25 always projects forward whenever the power-feeding connector 1 is in the normal state.

The stopper member 27 is provided on a back end of the slider 25, in the inside of the case 9. The stopper member 27 is pressed in a direction of the connector bar 16 (that is, in a direction perpendicular to a sliding direction of the slider 25) by an elastic member 31 (in a direction of the arrow I in FIG. 3 (*b*)). As illustrated in FIG. 3 (*b*), for example, a side surface of the stopper member 27 touches a pin 32 of the connector bar 16. Accordingly, the stopper member 27 prevents the connector bar 16 from moving further forward, and thereby the movement of the holding member 3, on which the connector bar 16 is fixed, with respect to the case 9 is restricted and the holding member 3 is stopped.

For example, even when the case 9 is inserted diagonally into the power-receiving connector 33 or even when the case 9 touches a periphery part of the power-receiving connector 33, the slider 25 and the stopper member 27 prevent the holding member 3 from moving forward with respect to the case 9. That is, in the case where the stopper member 27 that serves as the case-locking mechanism is in a locked state, even if the holding member 3 is inserted, the case 9 is not pushed inwardly to the holding member 3.

A part of the slider 25 can be viewed through the hole 24. That is, in a state where the slider 25 projects forward, by marking or coloring a position that corresponds to a position of the hole 24, it is possible to visually recognize through the hole 24 that the slider 25 projects forward.

Furthermore, a concave part 35 is formed at a position of an inner surface of the power-receiving connector 33, which corresponds to a position of the locking pin 17*a* in a state where the case 9 is arranged on the part of the power-receiving connector 33. In order to position the locking pin 17*a* with the concave part 35 or position the female terminal with the male terminal described above, a guide, etc. for positioning the case 9 with the power-receiving connector 33 may be formed on an outer surface of the case 9.

Secondly, as illustrated in FIG. 4, when the holding member of the power-feeding connector 1 is pushed to a side of the power-receiving connector 33 (in a direction of the arrow C in FIG. 4 (*a*)), the step of the case 9 contacts the periphery part of the power-receiving connector 33. The slider 25 projects on the step of the case 9, and accordingly the slider 25 touches the periphery part of the power-receiving connector 33.

Therefore, as illustrated in FIG. 4 (*b*), the slider 25 is pushed backwardly (toward the inside of the case 9, in a direction of the arrow A in FIG. 4 (*b*)) while resisting to a forward pressing force by the elastic member 29. The back end of the slider 25 touches the stopper member 27. A taper part 27*a* is formed on a surface where the stopper member 27 touches the slider 25.

Accordingly, when the slider 25 moves backwardly (in the direction of the arrow A in FIG. 4 (*b*)), the back end of the slider 25 slides on the taper part 27*a* and then a movement direction of the stopper member 27 is changed. That is, the stopper member 27 moves substantially perpendicular to the sliding direction of the slider 25 (in a direction of the arrow B in FIG. 4 (*b*)) while resisting to a pressing force by the elastic member 31. The stopper member 27 moves away from the pin 32, and thereby the stopper member 27 and the pin 32 (the connector bar 16) that have been engaged with each other are unlocked.

The insertion detecting means for detecting whether the case 9 is inserted into the power-receiving connector 33 are not limited to the slider 25 illustrated in the drawings, however, any mechanisms may be applied as long as they work when the case 9 is inserted. Furthermore, a mechanism for unlocking the case-locking mechanism at the time of detection by the insertion detecting means needs not necessarily be the stopper member 27 illustrated in the drawings, however, any mechanisms may be applied as long as they can unlock the engaged state in response to results detected by the insertion detecting means.

As described above, the state where the case 9 and the holding member 3 are engaged with each other is unlocked by inserting the case 9 into the power-receiving connector 33 completely, which makes it possible to allow the case 9 and the holding member 3 to move freely. A part of the slider 25 can be viewed through the hole 24. That is, in a state where the slider 25 is pushed backwardly, by marking or coloring a position that corresponds to a position of the hole 24, it is possible to visually recognize through the hole 24 that the slider 25 is pushed backwardly. In this way, it is possible to visually recognize that the case 9 is successfully inserted into the power-receiving connector 33.

Thirdly, as illustrated in FIG. 5, the holding member 3 of the power-feeding connector 1 is further pushed to the side of the power-receiving connector 33 (in a direction of the arrow C in FIG. 5 (*a*)). The holding member 3 cannot be pushed any further because the case 9 touches the power-receiving connector 33. On the other hand, the state where the holding member 3 is stopped with respect to the case 9 is unlocked. Accordingly, as illustrated in FIG. 5 (*b*), the pin 32 does not touch the stopper member 27. The connector bar 16 does not touch the stopper member 27, and thus moves forward (in a direction of the arrow C in FIG. 5 (*b*)).

In this way, it is possible to move the holding member 3 forward with respect to the case 9. In this process, the connector body 11 moves forward (in a direction of the arrow E in FIG. 5) with respect to the case 9 with the movement of the holding member 3. The connector body 11 projects from a front portion of the case 9, and accordingly it is connected to the connector body 37 of the power-receiving connector.

Here, in the case where the ratio of movement distances from the holding member 3 to the case 9 and from the connector body 11 to the case 9 is set to be 2:1, the holding member is pushed from a distance twice as far as a space length for connection between the connector bodies 11 and 37, and thereby the connector body 11 can move a distance enough for the connectors to be connected. In other word, the connectors can be connected by pushing the holding member 3 with half force of force for connecting the connectors (that is resisting force for connection). The speed reducing ratio of the speed reduction mechanism is set arbitrarily considering resisting force for connection or user-friendliness.

In a state illustrated in FIG. 5 (*a*), as described above, the locking pin 17*a* is engaged with the concave part 35. Consequently, the power-receiving connector 33 and the power-feeding connector 1 are locked in a state where they are connected with each other. Furthermore, the locking pin 7*a* formed at an end portion of the operating part 7 is engaged with the concave part 19, and thereby the holding member 3 is locked so that it does not move with respect to the case 9. Therefore, even when a cable, etc. (not shown) is pulled, the power-feeding connector 1 is not easily disconnected from the power-receiving connector 33.

In order to disconnect the power-feeding connector 1, it is necessary to unlock the engaged locking pin 17*a* by the process in which the holding member 3 is pulled back in a state where the locking pin 7*a* is pushed upwardly by pushing the end portion of the operating part 7 so that the engaging part 17*b* moves onto the engaging part 21. By this process, the power-feeding connector 1 can be easily disconnected.

Figure 6:
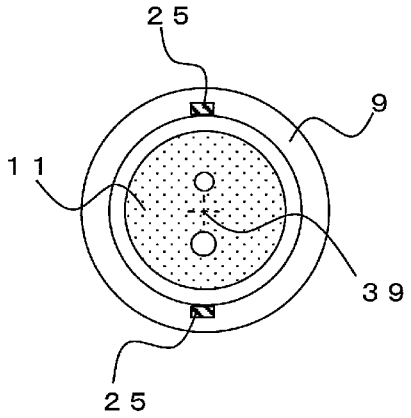
FIG. 6 is a front view illustrating an example in which a plurality of sliders 25 is provided.

In the example described above, a pair of the slider 25 and the stopper member 27 is arranged therein, however, the present invention is not limited to this arrangement. For example, as illustrated in FIG. 6, a plurality of the sliders 25 (and the corresponding stopper members 27, etc.) may be arranged therein.

When a plurality of the sliders 25 is arranged therein, they are desired to be arranged at point symmetrical positions relative to a connector center 39 that is a center of the connector body 11 (the case 9) in a front view of the connector body 11. With this configuration, it is possible to insert the case 9 into the power-receiving connector 33 accurately because a pushing force of the sliders 25 is applied equally on the connector center 39.

As described above, the power-feeding connector 1 according to this embodiment does not require a great force and is easily connected to a power-receiving connector. Especially by using the power-feeding connector 1, an operator is able to understand connecting procedures easily and sensually because a direction to which an operator pushes the holding member is the same as a connecting direction of the connector body 11.

Furthermore, the case-locking mechanism that locks the case 9 and the holding member 3 is provided therein, and accordingly the holding member 3 does not move with respect to the case 9 in the normal state. In this way, the holding member 3 does not move with respect to the case 9 in a state where the case 9 is not completely inserted into the power-receiving connector 33.

Furthermore, because the speed reduction mechanism is provided for the movement of the holding member 3 and the connector body 11 with respect to the case 9, the force required to connect the connectors with each other can be reduced. Still further, when the speed reduction mechanism is used with the case-locking mechanism described above, the speed reduction mechanism does not work before inserting the case 9 into the power-receiving connector 33 but works after the case 9 is completely inserted into the power-receiving connector in order to connect the connectors with each other.

Furthermore, because the slider 25 is used as the insertion detecting means, it is possible to successfully detect that the case 9 is inserted into the power-receiving connector 33 with a simple configuration. Still further, because a position of the slider 25 can be viewed through the hole 24 that is formed in the case 9, it is possible to visually recognize whether the slider 25 is successfully pushed. That is, it is able to visually recognize whether the case 9 is completely inserted into the power-receiving connector 33.

Figure 7:
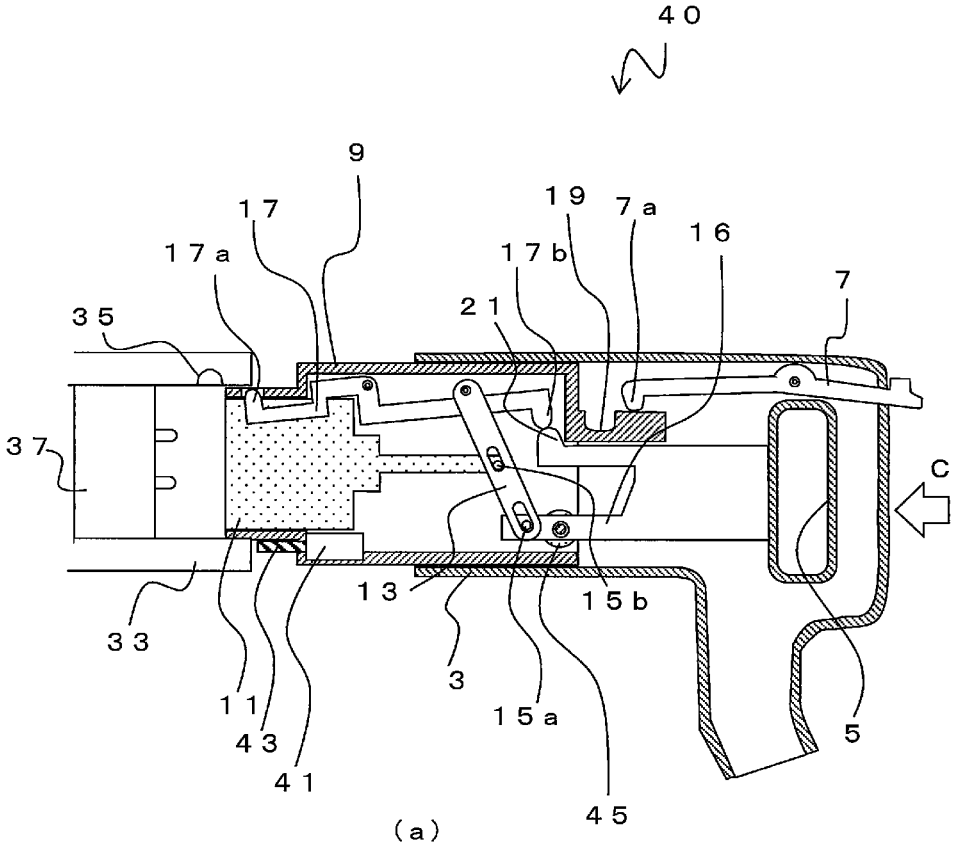
FIG. 7 illustrates a state where a power-feeding connector 40 and a power-receiving connector 33 are connected with each other, and particularly FIG. 7 (*a*) is a cross-sectional side view and FIG. 7 (*b*) is a bottom perspective view illustrating operations of a switch 41, etc.
Figure 7:
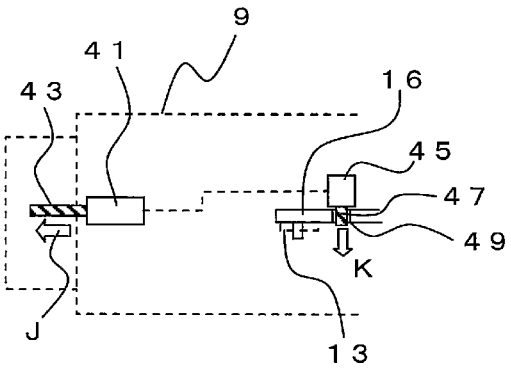
Figure 8:
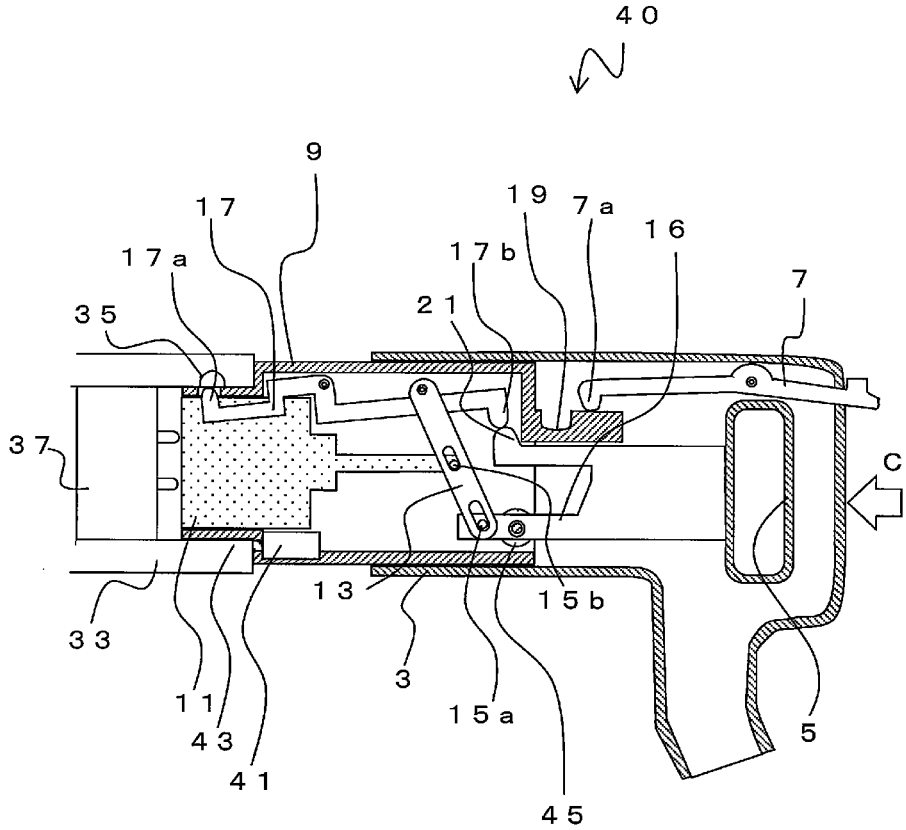
FIG. 8 illustrates a state where a power-feeding connector 40 and a power-receiving connector 33 are connected with each other, and particularly FIG. 8 (*a*) is a cross-sectional side view and FIG. 8 (*b*) is a bottom perspective view illustrating operations of a switch 41, etc.
Figure 8:
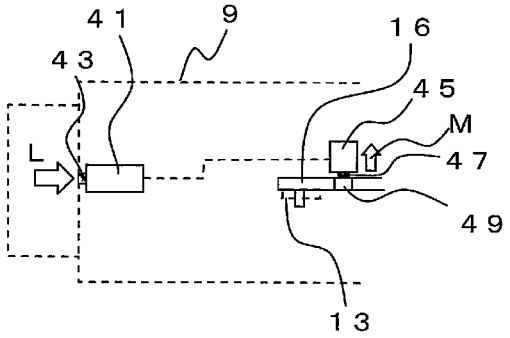
Figure 9:
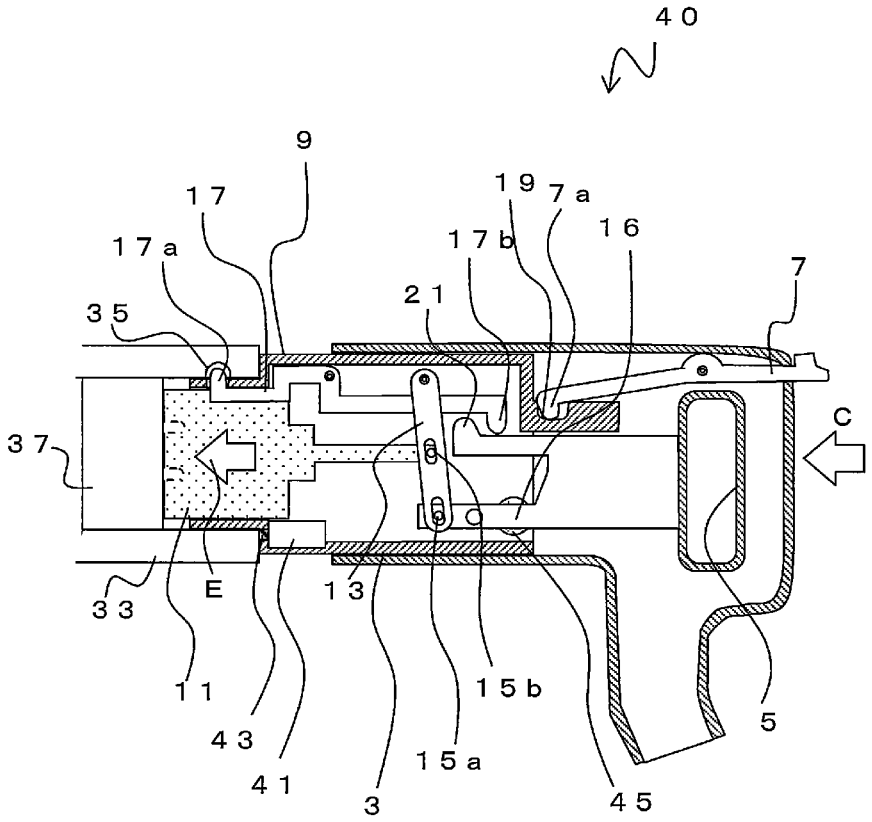
FIG. 9 illustrates a state where a power-feeding connector 40 and a power-receiving connector 33 are connected with each other, and particularly FIG. 9 (*a*) is a cross-sectional side view and FIG. 9 (*b*) is a bottom perspective view illustrating operations of a switch 41, etc.
Figure 9:
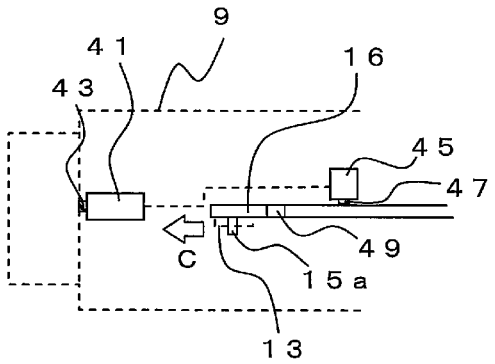
Figure 10:
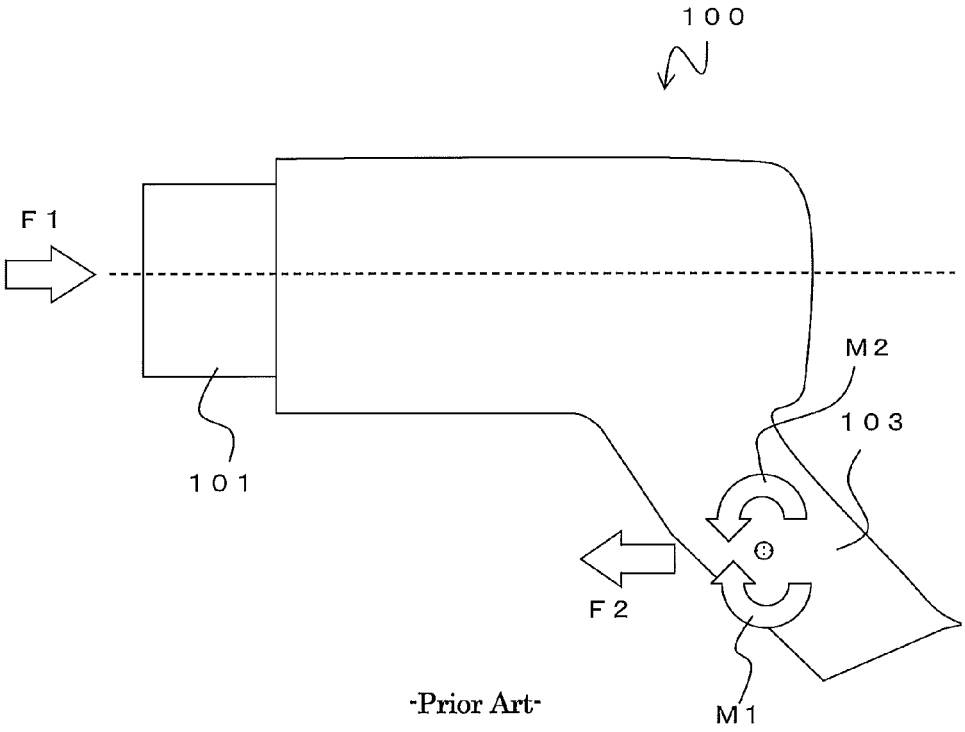
FIG. 10 illustrates a conventional power-feeding connector 100.

Next, a second embodiment according to the present invention will be described below. FIG. 7 to FIG. 9 illustrate processes for connecting a power-feeding connector 40 according to the second embodiment to the power-receiving connector 33, and particularly FIG. 7(*a*) to FIG. 9 (*a*) are cross-sectional side views and FIG. 7 (*b*) to FIG. 9 (*b*) are bottom perspective views illustrating operations of a switch, etc. In the second embodiment, the same numerals as those of FIG. 1 to FIG. 5 are allotted to configurations having the same functions as those illustrated in FIG. 1 to FIG. 5, and the overlapping explanations will be omitted.

The power-feeding connector 40 is configured in substantially the same manner as the power-feeding connector 1, however, there are differences in the insertion detecting means and the case-locking mechanism. The power-feeding connector 40 includes a switch 41 and a stopper member 45, etc. instead of the slider 25 and the stopper member 27, etc.

As illustrated in FIG. 7 (*b*), the switch 41 as an insertion detecting part is provided at the step of the case 9. The switch 41 is provided with a pin 43 that can slide in an axial direction (a movement direction of the case 9 as well as an inserting and removing direction of the connector). An end of the pin 43 projects forward and is pushed from the front portion of the case 9 (in a direction of the arrow J in FIG. 7 (*b*)). The switch 41 is a known switch such as a limit switch and a proximity switch, and any switches may be applied as long as the switch can detect that the pin 43 is pushed into a body of the switch 41.

A hole 49 is provided in the connector bar 16. The stopper member 45 is arranged toward a direction vertical to the axial direction (the movement direction of the case 9 as well as the inserting and removing direction of the connector) at a position to which the hole 49 corresponds in the normal state, in the inside of the case 9. The stopper member 45 can be actuated by electromagnetic solenoid, etc to operate the pin 47. That is, by operating the stopper member 45, it is possible to insert and remove the pin 47 with respect to the hole 49.

In the normal state, that is, in the case where the pin 43 of the switch 41 is pushed forward, the pin 47 of the stopper member 45 is maintained with being inserted into the hole 49 (in a direction of the arrow K in FIG. 7 (*b*)). In this state, because the pin 47 is inserted into the hole 49, the connector bar 16 is stopped by the stopper member 45. Accordingly, the holding member 3 cannot move with respect to the case 9.

Secondly, as illustrated in FIG. 8, when the holding member 3 of the power-feeding connector 40 is pushed toward the side of the power-receiving connector 33 (in a direction of the arrow C in FIG. 7 (*a*)), the step of the case 9 contacts the periphery part of the power-receiving connector 33. The pin 43 projects on the step of the case 9, and accordingly the pin 43 contacts the periphery part of the power-receiving connector 33.

Therefore, as illustrated in FIG. 8 (*b*), the pin 43 is pushed backwardly (into the inside of a body of the switch 41, in a direction of the arrow L in FIG. 8 (*b*)). When the pin 43 is pushed backwardly, the switch 41 actuates the stopper member 45 and then the pin 47 is removed from the hole 49 (in a direction of the arrow M in FIG. 8 (*b*)). Accordingly, the state where the connector bar 16 is stopped by the stopper member 45 is unlocked.

Thirdly, as illustrated in FIG. 9, the holding member 3 of the power-feeding connector 40 is further pushed to the side of the power-receiving connector 33 (in a direction of the arrow C in FIG. 9 (*a*)). As described above, the holding member 3 cannot be pushed any further because the case 9 touches the power-receiving connector 33. On the other hand, the state where the holding member 3 is stopped with respect to the case 9 is unlocked. That is, as illustrated in FIG. 9 (*b*), the connector bar 16 does not touch the stopper member 45 (the pin 47), and thus the connector bar 16 moves forward (in a direction of the arrow C in FIG. 9 (*a*)).

In this way, it is possible to move the holding member 3 forward with respect to the case 9. In this process, the connector body 11 moves forward (in a direction of the arrow E in FIG. 9 (*a*)) with respect to the case 9 with the movement of the holding member 3. The connector body 11 projects from the front portion of the case 9, and accordingly it is connected to the connector body 37 of the power-receiving connector.

According to the power-feeding connector 40 of the second embodiment, it is possible to obtain the same effect as that of the power-feeding connector 1. Furthermore, only a small force is required at the time of inserting the connector because the stopper member 45 is actuated by an electrical signal from the switch that is used as the insertion detecting means.

The embodiments are described above with reference to the attached drawings, however, the technical scope of the present invention is not limited by the embodiments above. It is obvious that a person skilled in the art can easily make the various examples of change or modifications within the category of the technical idea described in the claim, and moreover, it is understood that such examples naturally belong to the technical scope of the present invention.

For example, the shape of the holding member 3 and the arrangement of each constituent elements in the inside of the case 9 and the shape thereof are not limited to the examples illustrated in the drawings.

DESCRIPTION OF NOTATIONS

1, 40 power-feeding connector
3 holding member
5 handle
7 operating part
7*a* locking pin
9 case
11 connector body
13 arm
15*a*, 15*b* connecting part
16 connector bar
17 locking member
17*a* locking pin
17*b* engaging part
19 concave part
21 engaging part
23*a*, 23*b*, 23*c* pin
24 hole
25 slider
27, 45 stopper member
27*a* taper part
29 elastic member
31 elastic member
32 pin
33 power-receiving connector
35 concave part
37 connector body
39 connector center
41 switch

43 pin
47 pin
49 hole
100 power-feeding connector
101 connector body
103 handle

The invention claimed is:

1. A power feed connector used for an automobile, comprising:

a connector body;

a case that accommodates the connector body therein;

a holding member that is attached to the case; and a case-locking mechanism that restricts a movement of the case with respect to the holding member, wherein the holding member has a handle at one of the end portion thereof, the handle is formed such that at least a part of the handle is set on an extended line of a central axis of the connector body, the connector body and the holding member are slidable in a substantially same axial direction with respect to the case when the case-locking mechanism is unlocked, and the connector body is movable forward with respect to the case with a movement of the holding member when the holding member moves forward with respect to the case in a state where the case-locking mechanism is unlocked.

2. The power feed connector according to claim 1, wherein a speed reduction mechanism is provided in the holding member and the holding member and the connector body move with respect to the case via the speed reduction mechanism, and when the holding member moves with respect to the case, a movement distance of the connector body with respect to the case becomes smaller than a movement distance of the holding member with respect to the case.

3. The power feed connector according to claim 1, further comprising insertion detecting means that detect the case is inserted into a power-receiving connector, wherein the insertion detecting means are configured to unlock the case-locking mechanism when detecting that the case is inserted into the power-receiving connector.

4. A power feed connector used for an automobile, comprising:

a connector body;

a case that accommodates the connector body therein;

a holding member that is attached to the case; and a case-locking mechanism that restricts a movement of the case with respect to the holding member, wherein the connector body and the holding member are slidable in a substantially same axial direction with respect to the case when the case-locking mechanism is unlocked, the connector body is movable forward with respect to the case with a movement of the holding member when the holding member moves forward with respect to the case in a state where the case-locking mechanism is unlocked, the insertion detecting means include a slider that is formed slidably in an inserting and removing direction of the case, on a portion of the case which inserts into the power-receiving connector, and an elastic member that urges the slider in an inserting direction of the case, the case-locking mechanism is a stopper member that locks the case and the holding member, and when the slider touches the power-receiving connector and is pushed inwardly to the case, the stopper member moves so that the case-locking mechanism is unlocked.

5. The power feed connector according to claim 4, wherein a plurality of sliders is arranged symmetrically with each other against a central axis of the connector body.

6. The power feed connector according to claim 4, wherein the case is provided with a hole, and a position of the slider in an inside of the case is viewed through the hole.

7. A power feed connector used for an automobile, comprising:

a connector body;

a case that accommodates the connector body therein;

a holding member that is attached to the case;

a case-locking mechanism that restricts a movement of the case with respect to the holding member; and insertion detecting means that detect the case is inserted into a power-receiving connector, wherein the connector body and the holding member are slidable in a substantially same axial direction with respect to the case when the case-locking mechanism is unlocked, the connector body is movable forward with respect to the case with a movement of the holding member when the holding member moves forward with respect to the case in a state where the case-locking mechanism is unlocked, the insertion detecting means are configured to unlock the case-locking mechanism when detecting that the case is inserted into the power-receiving connector, the insertion detecting means include a pin that is formed slidably in an inserting and removing direction of the case, on a portion of the case which inserts into the power-receiving connector, an elastic member that urges the pin in an inserting direction of the case, and a switch that detects the pin resists the elastic member and is pushed, the case-locking mechanism is a stopper member that locks the case and the holding member and is actuated by electromagnetic solenoid, and when detecting that the pin touches the power-receiving connector and is pushed inwardly to the case, the switch actuates the electromagnetic solenoid to move the stopper member so that the case-locking mechanism is unlocked.

* * * * *